US009537211B2

(12) United States Patent
Scott et al.

(10) Patent No.: US 9,537,211 B2
(45) **Date of Patent: *Jan. 3, 2017**

(54) MULTI-FEED DIVERSITY RECEIVE SYSTEM AND METHOD

(71) Applicant: TROLL SYSTEMS CORPORATION, Valencia, CA (US)

(72) Inventors: Julian Scott, Glendale, CA (US); Jeff Hopkins, Valencia, CA (US)

(73) Assignee: TROLL SYSTEMS CORPORATION, Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/715,386

(22) Filed: May 18, 2015

(65) Prior Publication Data

US 2015/0249287 A1 Sep. 3, 2015

Related U.S. Application Data

(63) Continuation of application No. 12/874,974, filed on Sep. 2, 2010, now Pat. No. 9,035,839.

(60) Provisional application No. 61/275,933, filed on Sep. 3, 2009.

(51) Int. Cl.

| | |
|---|---|
| ***H01Q 3/12*** | (2006.01) |
| ***H01Q 3/02*** | (2006.01) |
| ***H01Q 3/24*** | (2006.01) |
| ***H01Q 3/26*** | (2006.01) |
| ***H01Q 25/00*** | (2006.01) |
| ***H01Q 3/20*** | (2006.01) |

(52) U.S. Cl.

CPC ..... *H01Q 3/02* (2013.01); *H01Q 3/20* (2013.01); *H01Q 3/245* (2013.01); *H01Q 3/2658* (2013.01); *H01Q 25/007* (2013.01)

(58) Field of Classification Search

CPC ..... H01Q 3/02; H01Q 3/20; H01Q 3/245

USPC ..... 343/776, 777, 779, 839, 840; 342/359

See application file for complete search history.

(56) References Cited

U.S. PATENT DOCUMENTS

| | | | | |
|---|---|---|---|---|
| 4,090,203 | A | 5/1978 | Duncan | |
| 4,187,508 | A | 2/1980 | Evans | |
| 4,349,827 | A | 9/1982 | Bixler | |
| 9,035,839 | B2 * | 5/2015 | Scott | H01Q 3/245 343/761 |
| 2003/0025644 | A1 | 2/2003 | Judasz | |
| 2005/0259026 | A1 | 11/2005 | Cook | |
| 2007/0285329 | A1 | 12/2007 | Flynn | |
| 2008/0062056 | A1 | 3/2008 | Hoferer | |
| 2008/0303736 | A1 | 12/2008 | Leveque | |

OTHER PUBLICATIONS

Comly, Dick, Parabolic Antennas and their Feeds, Pack Rat Notes, available at http://www.packratvhf.com/Article 9/DISH AOG.html. Sep. 1995.

(Continued)

*Primary Examiner* — Dieu H Duong
(74) *Attorney, Agent, or Firm* — EIP US LLP

(57) ABSTRACT

Embodiments disclosed herein relate to diversity receive systems and methods. An antenna system may comprise a reflector and a plurality of feed antennas configured to receive a wireless signal from a common source with directional diversity. A receive system may comprise such antenna system in combination with a plurality of receivers and/or demodulators, and in combination with a combiner and/or controller.

19 Claims, 12 Drawing Sheets

(56) References Cited

OTHER PUBLICATIONS

DIRECTV, Inc., Installation Manual: DIRECTV® Multi-Satellite Dish Antenna with Integrated Triple LNB and Built-in Multi-Switch. Apr. 17, 2003 Rev.3.
Satellite Dish, retrieved Sep. 2, 2009, from http://en.wikipedia.org/wiki|Satellite_dish.

* cited by examiner

MULTI-FEED DIVERSITY RECEIVE SYSTEM AND METHOD

CROSS REFERENCE TO RELATED APPLICATIONS

This application is a continuation of U.S. patent application Ser. No. 12/874,974, filed Sep. 2, 2010 and issued as U.S. Pat. No. 9,035,839, which claims the benefit of U.S. Provisional Application No. 61/275,933, filed Sep. 3, 2009. The entire contents of each of the above-referenced patent applications are hereby incorporated by reference.

BACKGROUND

Embodiments disclosed herein relate to wireless transmit and receive systems. More specifically, embodiments herein may relate to a multi-feed diversity tracking antenna system.

A traditional radio frequency (RF) link consists of both a transmit and receive system. Such RF link may use the digital COFDM (Coded Orthogonal Frequency Division Multiplexing) modulation/demodulation schemes to transmit and/or receive audio, encapsulated data, compressed video, or other information or data. The transmit system takes the information and converts it into a modulated RF signal using a transmitter and radiates that energy into the air via an antenna. The receive system uses an antenna to collect the RF energy and feed it to a receiver which then demodulates the signal back into the original information.

Between the output of the transmit antenna and the input of the receive antenna, the RF signal propagates through the air getting attenuated and bounced off terrain, buildings, or water. As received at the receive antenna, the signal typically should have enough power (from the transmitter) and gain (from the receive antenna) to overcome the attenuation due to the air and to satisfy the threshold signal level required by the receiver. Attenuation due to the air is dependent on a number of factors, such as distance traveled, frequency of the signal (higher frequency signals generally get attenuated more), and atmospheric conditions (hot/cold and dry/wet air may all affect the attenuation). The attenuation can be roughly calculated, but greater attenuation called fading may occur under certain conditions. Such greater attenuation must be accounted for when designing receive systems.

In addition, the receive system may also receive none, some, or all of the bounced signals, which is known as natural multi-path. This natural multi-path presents multiple images of the same signal at the receiver due to paths having varied lengths which are taken by the bounced signals to get from the transmit antenna to the receive antenna. In addition, the system may receive other transmitted signals of the same, or similar, frequency and power levels, known as unnatural multi-path. To receive a desired signal, the system can preferably discriminate against and overcome both forms of multi-path to demodulate the desired signal.

Problems further to those described above may also be experienced when receiving a signal. For example, too much received signal, be it a desired signal or signal from natural and/or unnatural multi-path, can be a problem due to an input amplifier of the receiver being driven into a non-linear region and causing unrecoverable distortions of the desired signal.

A need exists for improved wireless communication systems and methods, for example for use with the transmission and reception of RF signals. More specifically, a need exists for improved receive systems and methods of controlling those receive systems.

SUMMARY

One embodiment includes a system for receiving wireless signals. The system comprises a plurality of feed antennas configured to receive a wireless signal from a common source, and a reflector configured to reflect the wireless signal towards the plurality of feed antennas. The plurality of feed antennas may be arranged to provide spatial diversity when receiving the wireless signal.

Another embodiment includes a method of receiving a wireless signal. The method comprises receiving the wireless signal from a common source at a plurality of spatially diverse feed antennas facing in a plurality of directions, demodulating the signal at each of a plurality of demodulators connected to a respective one of the feed antennas, outputting a packet at each of the demodulators, and generating good packets from the demodulator output packets. The wireless signal may have been reflected off of a reflector. The packets may be derived from the received signal.

Yet another embodiment includes a system for receiving wireless signals. The system comprises a reflector configured to reflect the wireless signal, a plurality of feed antennas, said plurality of feed antennas being mechanically attached to the reflector and configured to receive said reflected signal, and a plurality of demodulators configured to output a data packet derived from the received signal. Each demodulator is connected to a respective one of the plurality of feed antennas. The plurality of feed antennas may be arranged to provide spatial diversity when receiving the signal. The system further comprises a combiner configured to receive the data packets output from the plurality of demodulators and configured to output a combined packet stream comprising good packets, and a controller configured to determine which of the plurality of feed antennas received the wireless signal with the highest robustness and configured to cause the reflector to rotate such that the signal is subsequently received by the plurality of feed antennas with an increased robustness.

DETAILED DESCRIPTION

Figure 1:
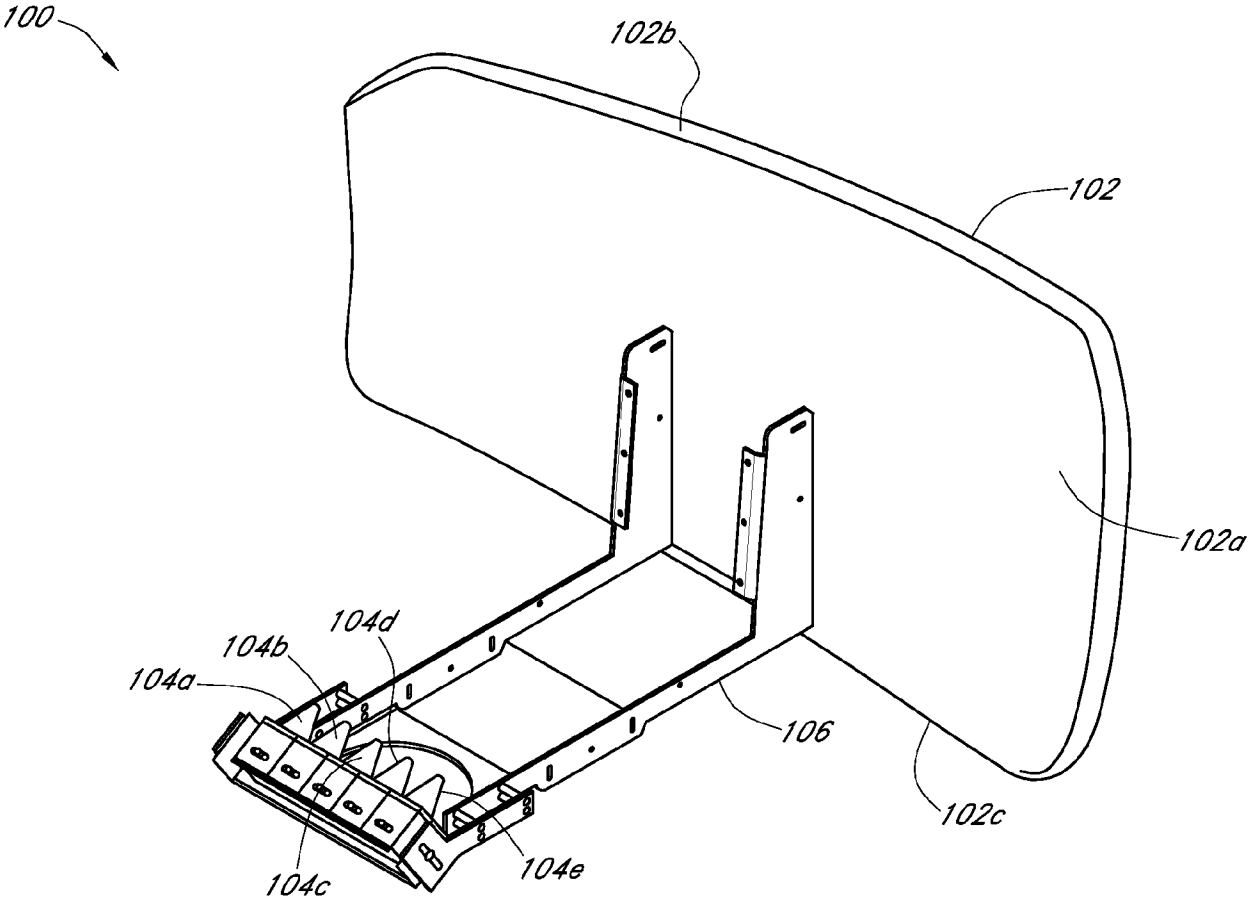
FIG. 1 is a perspective view of an embodiment of an antenna system including a parabolic reflector and a plurality of feed antennas.

Depending on the application, one of several types of antennas can be utilized to implement a wireless communication system. For example, types of antennas that may be used are omni, sector, and directional antennas. Those skilled in the art will understand that an omni antenna may radiate energy, for example RF energy, approximately in and receive energy approximately from all directions, i.e. in a 360 degree azimuth. Those skilled in the art will also understand that a sector antenna may radiate or receive a cone of energy that is generally between approximately 50 and approximately 120 degrees, and a directional antenna may radiate or receive a beam of energy generally in one or more determined directions with respect to the antenna. Directional antennas may have an angle (beam-width) of signal reception or transmission that is less than that of a sector antenna, which angle may be determined by the specific configuration of the directional antenna. An example of a direction antenna includes a parabolic antenna. The beam-width of such parabolic antenna may, for example, be determined by the size and shape of its parabolic reflector and the frequency being transmitted or received. The beam of energy transmitted or received by a parabolic antenna, and certain other directional antennas, may in some instances be referred to as a pencil beam because of its relatively narrow width as compared to the energy radiated by other types of antennas. Antennas may be "polarized" so that signals of differing polarizations can be transmitted or received and discriminated against. Such polarized antennas may assist in capturing only a desired signal.

Omni antennas generally have gains in the region of about 2 dBi to about 10 dBi (dBi refers to the relative gain/directivity of an antenna with respect to an equivalent isotropic antenna, which isotropic antenna radiates in all directions equally, expressed on the decibel logarithmic scale). Sector antennas generally have gains in the range of about 10 dBi to about 16 dBi. Directional antennas generally have a gain greater than about 20 dBi with beam-widths of less than about 10 degrees. In this description, the term "high gain" will generally be used to describe a gain that is higher than the 16 dBi that is typically achieved with generally known sector antennas as described above. Sector and directional antennas need to be pointed, either manually or automatically, towards a target receive system or source transmit system, as their beam-widths are less than 360 degrees. Directional antennas specifically require the most care as their beam-widths are typically less than about 10 degrees and in some cases less than about 1 degree.

Those skilled in the art will understand that the above antenna descriptions apply to both antennas used in transmit systems, as well as antennas used in receive systems. Many antennas can be used as either a transmit or receive antenna, or both in the case of a bi-directional link. In addition, some receive systems can be used as transmit systems, and similarly some transmit systems can be used as receive systems. Although the use of the antennas as disclosed above may be described below in reference to embodiments specifically of a receive or transmit system, those skilled in the art will recognize that many concepts and teachings herein can also be used to implement either or both receive and transmission systems.

Transmit Systems

A transmitter may accept audio, video, and/or other data as its raw input and encode and modulate that data to a frequency required for transmission. The raw data may be compressed and/or encapsulated into an ASI (asynchronous serial interface) transport stream. This stream may be fed to a modulator. The modulator may spread the data out over multiple carriers, for example when the modulator comprises a COFDM modulator. The modulated data is up-converted to the required transmission frequency and may be amplified to the desired power level before being presented to an antenna for transmission. The antenna radiates the wireless energy from the transmitter into the air.

Receive Systems

Traditional receive systems receive the modulated energy and convert the energy back into its original form of audio, video, and/or other data using an antenna to capture the RF energy and a receiver to demodulate the signal. The radiated energy from the transmit system is picked up via the antenna. If the receive system comprises a sector or directional antenna, such antenna needs to be pointed, either manually or automatically, towards the transmit system. This need is due to the fact that the beam-widths of such antennas are less than 360 degrees. The directional antenna specifically requires the most care as the beam-widths are typically less than about 10 degrees and in some cases less than about 1 degree.

The receiver accepts the signal from the antenna. The received signal may be amplified, and then down-converted to the required demodulator input frequency range. The demodulator converts the signal back to a compressed form and/or may convert the signal back into an ASI stream. This converted signal is then fed to the decoder of the receiver, which decoder converts the signal back to the original source material at the decoder's output (for example to audio, video, and/or other data).

Many receive systems, or sites, are located on "high points" within a geographic area. These sites include tops of mountains, hills, buildings, and radio towers. The sites may be unmanned and remotely controlled from a central command and control site, adding additional complexity to the system.

Planning Wireless Systems

When planning a wireless link there are many factors to take into consideration. Important questions include: what are the link and distance requirements? What frequency can be used? What type of terrain will be encountered? Is the terrain urban, rural, mountainous, water? Are there other signals that might interfere with the transmitted signal or are there other signals that might be interfered by the transmitted signal? How much data needs to be transported across the link? Is the transmit platform stationary or mobile? How robust does the system need to be? What is the budget for the system?

The answers to these questions determine what equipment and how complex a system is required to provide an acceptably performing link. Long distances may require higher power transmitters and/or greater gain from the antennas to overcome atmospheric attenuation and fading. Certain wireless links are inherently "line of sight" systems and a transmitted signal will generally not pass through or bend around terrain or buildings. Bouncing off such terrain or buildings creates natural multi-path issues for the system. Thus, even shorter links can suffer from natural multi-path issues. Unnatural multi-path may be an issue if multiple users are allocated the same frequency or the operator wishes to use the same channel simultaneously. Using directional antennas and/or more sophisticated receiver technology may be required to minimize this type of interference. The use of directional antennas, however, may limit the azimuth of signal reception, or continual adjustment of such antennas may be necessary to ensure proper signal reception. Such adjustment may be slow or necessitate laborious input by a trained operator. The use of more sophisticated receiver technology may increase the cost of the system and add complexity.

Data transfer rates within a transmit and receive system are dependent on multiple parameters. For example, three such parameters include modulation type, forward error correction (FEC), and guard interval (GI). Low modulation types with high FEC and long GI typically yield a robust link largely immune to both forms of multi-path, but at the expense of data throughput. For large data throughputs, which are necessary for high-definition (HD) video, a higher modulation type with low FEC and increased GI is needed which reduces the system's immunity to multi-path. In general, an increase in the robustness of a link will necessitate lowering the amount of data that can be transmitted. Similarly, an increase in the amount of throughput will necessitate lowering the error corrections that are included in the signal.

Selecting a receive antenna with a narrowed beam-width (and thus an increased gain) will generally allow a signal to be received from a greater distance and will increase the strength of the received signal. A decrease in the beam-width, however, will necessitate that the antenna be more carefully positioned to correctly receive the signal. Similarly, selecting an antenna that may receive signals over a wide azimuth may decrease the strength at which signals may be received.

The Multi-Feed Enhancement

Embodiments of the receive system described herein relate to maximization of a high gain antenna beam portion of a transmitted wireless signal. The system may be used with a radio frequency (RF) link, for example that may be mobile or temporarily fixed. The RF link may use the digital COFDM (Coded Orthogonal Frequency Division Multiplexing) modulation/demodulation schemes to transmit either encapsulated data or compressed video (Standard Definition (SD) or High Definition (HD)). Such transmission may be executed with a Super High Frequency (SHF). Those skilled in the art will appreciate that embodiments described herein may also be utilized to receive wireless signals over a link other than an RF link, or may be used to receive signals that do not utilize the COFDM scheme or are not transmitted with an SHF.

The receive system includes an antenna system having a reflector, which may, for example, be parabolic, and a plurality of feed antennas, as will be described in more detail below. Using the receive system, a single feed antenna may be enhanced by adding additional feed antennas to a traditional single central feed antenna, for example on either side of a central feed antenna. The additional feed antennas may be linearly mounted in pairs on either side of the main, central feed. For example, two or more additional feed antennas may be mounted in the antenna system.

Receive system performance can be enhanced with the addition of diversity. Traditional diversity can be either frequency or spatial. Frequency diversity requires two transmitters on unique frequencies and two receivers; one receiver is set to one of the frequencies and the second receiver is set to the remaining frequency, wherein both signals are received by the same antennas. Spatial diversity uses two receive antennas, sometimes spaced apart by a minimum number of a desired frequency's wavelength, and two receivers, wherein a separate receiver is connected to each antenna. In general, one of a multi-path and signal fading characteristic is good when the other is bad. In some situations, performance is improved as much by using unique frequencies as by using multiple receive antennas. Switching between receiver outputs, manually or automatically, may allow a system to obtain the correct audio, video, and/or data. Frequency and spatial diversity can be combined to add additional robustness.

A system designed for higher data throughput may reduce multi-path interference with antenna choices and the use of diversity. If a platform is mobile, either receive or transmit, the complexity of the system goes up dramatically, requiring computer controlled antennas and auxiliary data links to provide positional information for the control system to "track" the platform.

One way to enhance traditional spatial diversity of a receive system includes using a third diversity option, which may be referred to as Maximal Ratio Combining (MRC). MRC enhances traditional spatial diversity (i.e. two antennas and two receivers) by considering receiver output quality at a packet level, for example at an ASI transport stream packet level. Each demodulator of the receive system presents, good or bad, packets to the MRC combiner, which in turn generates a good one from any of the demodulators outputting a good packet and then adds the good packet to a combined ASI transport stream. The system then repeats this process of generating a good packet for each subsequent packet. In this way, the decoder may receive a more robust transport stream than would be possible with only one antenna and one receiver. The combining is much more efficient, and can be executed much faster and using more automation than traditional spatial diversity. In some embodiments, MRC systems utilize two (2), three (3), four (4), five (5), six (6) or more antenna and receiver/demodulator combinations.

Embodiments disclosed herein may include a directional multi-feed high gain antenna system. Disclosed embodiments may allow for receiving a signal at high gain with an increased beam-width as compared to antennas known in the art, as well as for tracking of a signal source. Disclosed embodiments additionally may allow a high data throughput while maintaining the robustness of a received signal over a much greater distance than single feed antenna systems. To add to this, disclosed embodiments may provide a cost effective system that utilizes diversity to receive RF signals.

In some embodiments, the antenna system includes multiple receive components and may receive multiple feeds. Some embodiments may be used with a diversity RF tracking system comprising at least one steerable high gain directional antenna with a traditional central feed antenna and one or more additional feed antennas, for example a pair of additional feed antennas equally spaced about the central feed antenna. The signals from these feed antennas may be fed into one or more Maximal Ratio Combining (MRC) receive systems to enhance diversity.

As can be seen in a perspective view of an embodiment of an antenna system, illustrated in FIG. 1, the antenna system 100 may include a reflector 102 and a plurality of feed antennas 104*a*-104*e*. The reflector 102 is configured to reflect a wireless signal incident on a front face 102*a* of the reflector 102 towards one or more of the feed antennas 104*a*-104*e*. In the illustrated embodiment, the reflector 102 is shown as a parabolic reflector. Other shapes that reflect a wireless signal towards one or more of the feed antennas 104*a*-104*e* may be used. For example, the antenna system 100 may comprise a corner reflector, an off-center reflector system, or a Cassegrain reflector system. A parabolic shape is advantageous because of the relatively high gain at which one or more of the feed antennas can receive a wireless signal when the signal is reflected off of the parabolic reflector. The front face 102*a* may be solid, as illustrated in FIG. 1, or it may have holes formed therethrough. For example, the reflector 102 may comprise a mesh or a lattice. The reflector 102 may also be referred to in some embodiments as a dish.

The feed antennas 104*a*-104*e* are configured to receive a wireless signal from a common transmission source that has been reflected off of the reflector 102. The common transmission source may comprise one or multiple transmission antennas. In the illustrated embodiment, the feed antennas 104*a*-104*e* are shown as being attached to the reflector 102 by a support member 106. Thus, the feed antennas 104*a*-104*e* will move when the reflector 102 or the support member 106 moves, and therefore the antenna system 100 can be moved as an integral unit. The support member 106 may comprise any number of materials, such as a metal or alloy or plastic for example, and may be arranged in any of a variety of dispositions configured to attach one or more of the feed antennas 104*a*-104*e* to the reflector 102. For example, the support 106 may comprise a pair of substantially linear arms supporting the array of feed antennas 104*a*-104*e*, as illustrated in FIG. 1. As another example, the support 106 may comprise a single arm extending from the reflector 102, or may comprise three or more curvilinear buttresses, for example extending from a central portion of the reflector 102. In some embodiments, one or more of the feed antennas 104*a*-104*e* are not connected to the reflector 102.

In the illustrated embodiment, the feed antenna 104*c* is disposed at a focus of the parabola partially defined by the parabolic reflector. An antenna placed at the focus, such as the feed antenna 104*c*, may be called a central feed antenna, or may be said to be situated at a focus or prime focus of the reflector 102. In some embodiments, no feed antenna is placed at the prime focus.

In the illustrated embodiment, the feed antennas 104*a*, 104*e*, 104*b*, and 104*d* are disposed as symmetric pairs about the feed antenna 104*c*. Such feed antennas placed around a central feed antenna may be referred to as "additional" or "auxiliary" feed antennas. In other embodiments, there may be an unequal number of auxiliary feed antennas on either side of a central feed antenna and/or auxiliary feed antennas may be disposed in an asymmetric pattern about a central feed antenna. Similarly, a varying number of feed antennas may be disposed in a symmetric or asymmetric pattern about a focus of the reflector 102 in the absence of a central feed antenna.

Although the feed antennas 104*a*-104*e* are shown as being disposed in an approximately linear configuration parallel to an upper edge 102*b* or a lower edge 102*c* of the reflector 102, the feed antennas 104*a*-104*e* may be disposed in any number of configurations. Such configuration parallel to the upper edge 102*b* or to the lower edge 102*c* of the reflector 102 will generally be referred to herein as horizontal. In some embodiments, the feed antennas 104*a*-104*e* are additionally or instead spaced from each other in a direction transverse to the horizontal. In other embodiments, the feed antennas 104*a*-104*e* may be linearly arranged so as to be angled with respect to the upper edge 102*b* or the lower edge 102*c*. In some embodiments, the feed antennas 104*a*-104*e* are arranged in single direction, such as in a horizontal direction, without being linearly disposed, for example when arranged in a plurality of rows. Further, the feed antennas 104*a*-104*e* may be arranged so as to form a curve. For example, the feed antenna 104*c* may be located nearer to the reflector 102 than any of the other feed antennas, or conversely may be located farther from the reflector 102 than any of the other feed antennas. Those of skill in the art will appreciate other ways in which the feed antennas 104*a*-104*e* may be arranged.

The feed antennas 104*a*-104*e* are illustrated in FIG. 1 as being disposed as close to each other as their structure will allow. In some embodiments, two or more of the feed antennas 104*a*-104*e* may be spaced at a distance from each other. In some embodiments, a distance between the feed antennas may be adjusted, either manually or automatically, for example to tune reception of a wireless signal from a transmission source.

In the illustrated embodiment, the antenna system 100 comprises five feeds antennas 104*a*-104*e*. The antenna system 100 is not limited to five feed antennas, however, and may comprise a greater or lesser number of feed antennas. In some embodiments, the antenna system 100 comprises two, three, four, five, six, seven, eight, nine, ten, or more feed antennas or pairs of feed antennas, which may or may not be situated about a central feed antenna.

The plurality of feed antennas 104*a*-104*e* are arranged to provide spatial diversity when receiving an RF signal. The spatial diversity allows for more accurate and robust reception of a wireless signal, as described above. In some embodiments, the system utilizes MRC receiver technology. In such embodiments, each feed antenna is connected to a receiver, and packets are produced for inclusion in a transport stream, as will be described in additional detail below. For example, ASI packets may be produced for inclusion in an ASI transport stream.

As described above, the plurality of feed antennas 104*a*-104*d* are configured to receive a wireless signal from a common transmission source with spatial diversity. Antennas known in the prior art, in contrast, may be configured to receive signals from a plurality of different sources. For example, multi-satellite receivers known by those skilled in the art typically feature several antennas spaced relatively far apart to receive signals from several different satellites instead of a plurality of antennas situated in close proximity and configured to provide spatial diversity, as described herein.

Those of skill in the art will appreciate that in the illustrated embodiment, the plurality of feed antennas 104*a*-104*e* may comprise a plurality of "high gain" antennas utilizing a single reflector 102. The plurality of high gain feed antennas effectively increases the beam-width of the system in proportion to the number of additional feeds surrounding the main feed. Each feed antenna 104*a*-104*e*, along with the reflector 102, provides a high gain antenna with the beam of the antenna squinted relative to the central feed, as illustrated in FIGS. 2A-2E.

Figure 2A:
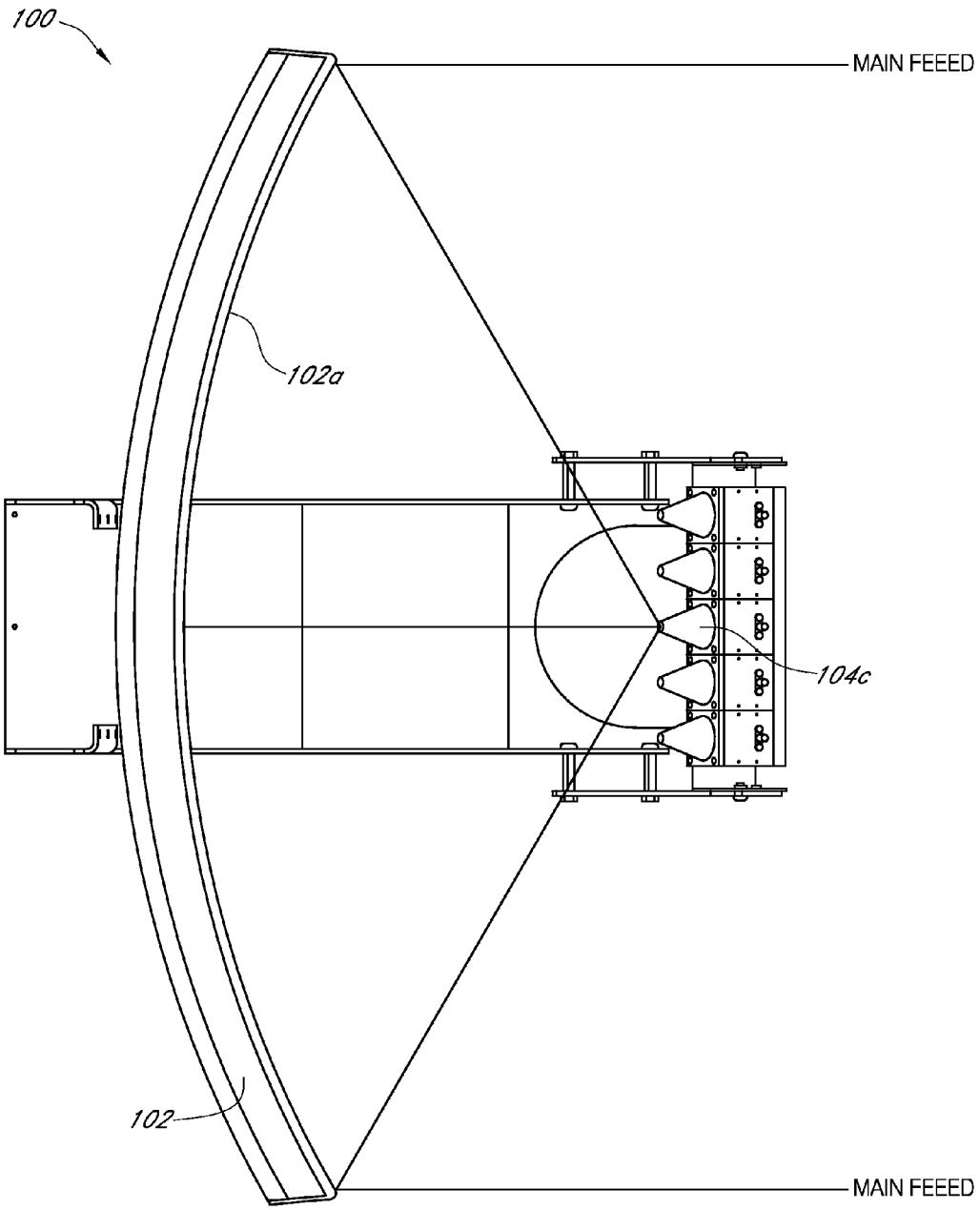
FIGS. 2A-2E are top views of the antenna system of FIG. 1 showing a plurality of receive paths over which the antenna system may receive signals from a transmission source.

As can be seen in a top view of the antenna system 100 in FIG. 2A, the central feed antenna 104*c* (at the prime focus) receives signals from a radiating RF signal in a direction generally designated as the "main feed." In general, signals travelling along a receive path parallel to the "main feed" that contact the face 102*a* will be reflected towards the feed antenna 104*c*. The reflector 102, which is illustrated as parabolic in this embodiment, is configured to reflect signals coming from the "main feed" direction to the focus of the reflector regardless of where the signals contact the face 102*a* of the reflector 102. The feed antenna 104*c* will also receive signals that are angled slightly with respect to the "main feed" direction. For example, the feed antenna 104*c* may be configured such that signals are received in an azimuth ranging from approximately 4 to 10 degrees. In some embodiments, the feed antenna 104*c* is configured such that the reception azimuth is from about 5 to 7 degrees. In some embodiments, the antenna system 100 is configured to have a gain of more than about 25 dBi when receiving signals from the general direction of the "main feed." In general, the strength of the received signals weakens as the angle from which it is received, as compared to the "main feed" direction, increases.

Placement of additional feed antennas around the central feed antenna increases the azimuth in which signals can be received with sufficient signal strength. For example, additional feed antennas 104*b* and 104*d* are effectively two antennas pointing a number of degrees to the left, and the right, of the main feed antenna 104*c* (at the prime focus of the reflector 102). These feed antennas experience maximum gain when receiving signals from a direction that is angled with respect to the "main feed" direction.

Figure 2B:
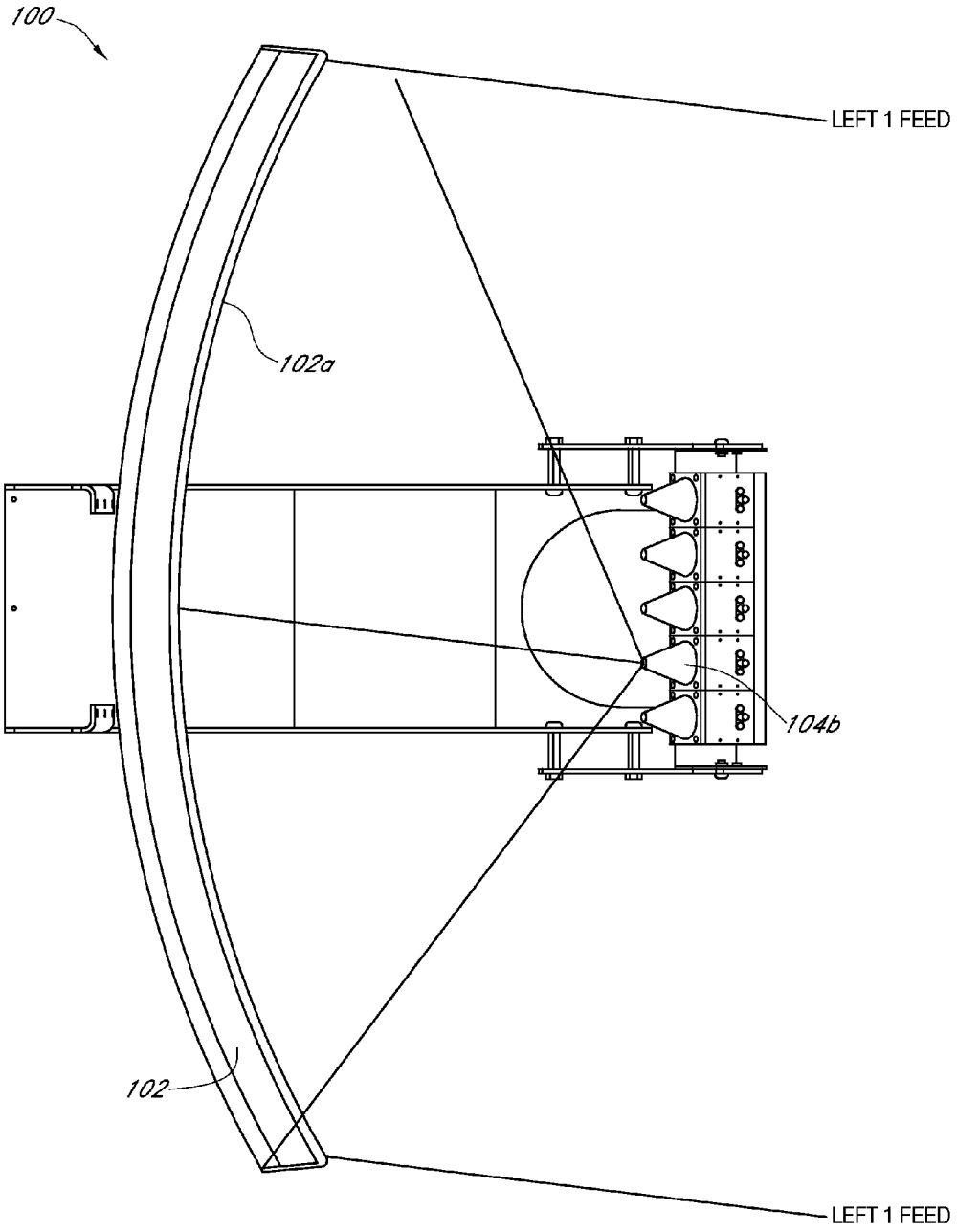
Figure 2C:
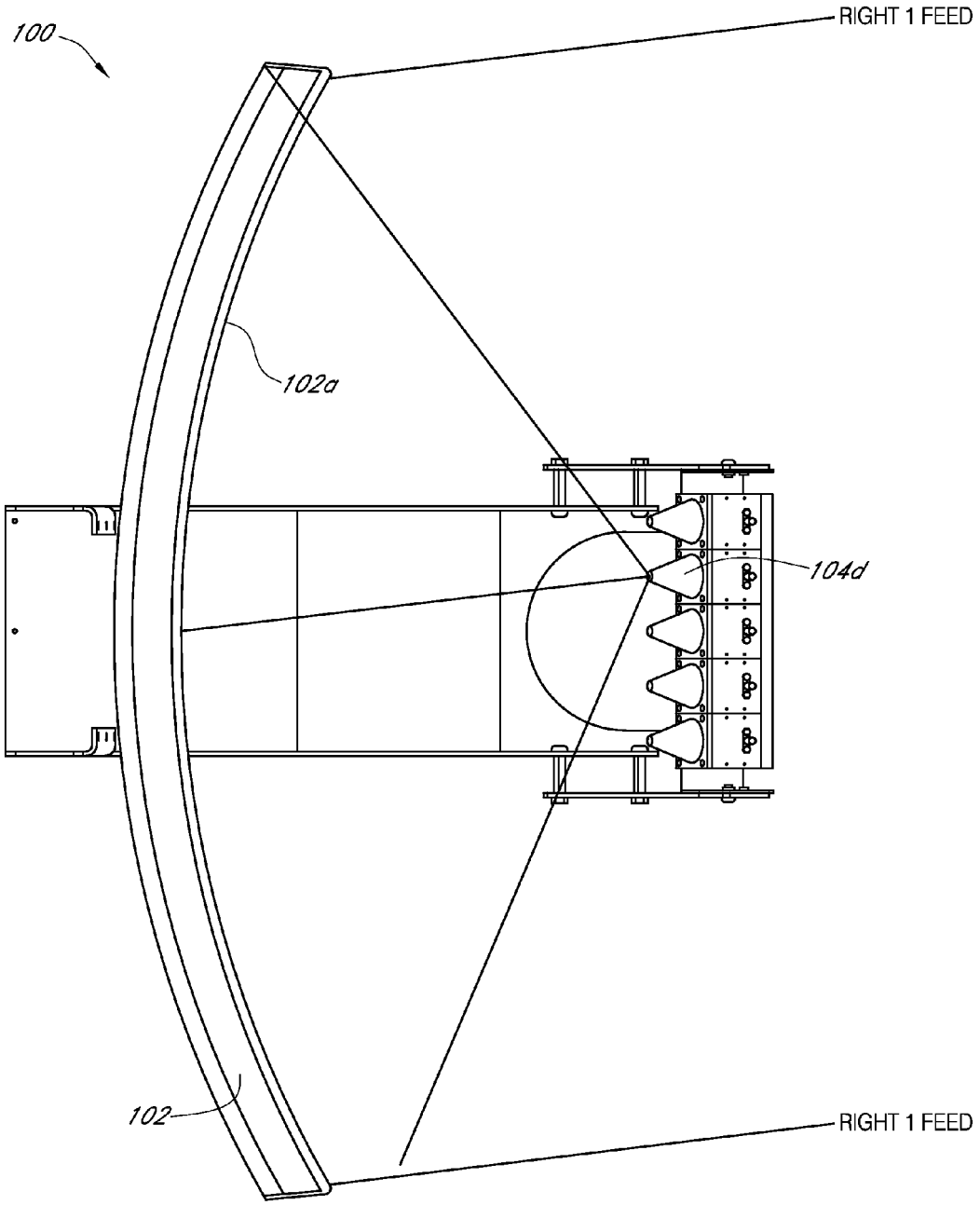

FIG. 2B is a top view of the antenna system 100 showing a "left 1 feed" direction. The feed antenna 104*b* will experience maximum gain when receiving signals from a direction that is generally parallel to the "left 1 feed direction." Similarly, FIG. 2C is a top view of the antenna system 100 showing a "right 1 feed" direction. The feed antenna 104*d* will experience maximum gain when receiving signals from a direction that is generally parallel to the "right 1 feed direction." In some embodiments, each of the "left 1 feed" and "right 1 feed" are angled from the "main feed" by about 6-7 degrees. Although the maximum gain of the feed antennas 104*b* and 104*d* in combination with the reflector 102 may be reduced as compared to the maximum gain of the central feed antenna 104*c* in combination with the reflector, the strength at which the feed antennas 104*b* and 104*d* receive signals from the "left 1 feed direction" and the "right 1 feed direction" is generally much higher than the strength with which the central feed antenna 104*c* would receive the same signals. In some embodiments, the maximum gain of the feed antennas 104*b* and 104*d* is reduced by about 6-7 dBi as compared to the maximum gain of the central feed antenna 104*c*. However, as one of skill in the art will appreciate from the above description, the combination of the central feed antenna 104*c* and the reflector 102 with one or both of the additional feed antennas 104*b* and 104*d* will effectively increase the azimuth of the antenna system 100, in some examples by about 12-14 degrees, as compared to an antenna system omitting auxiliary feed antennas.

Figure 2D:
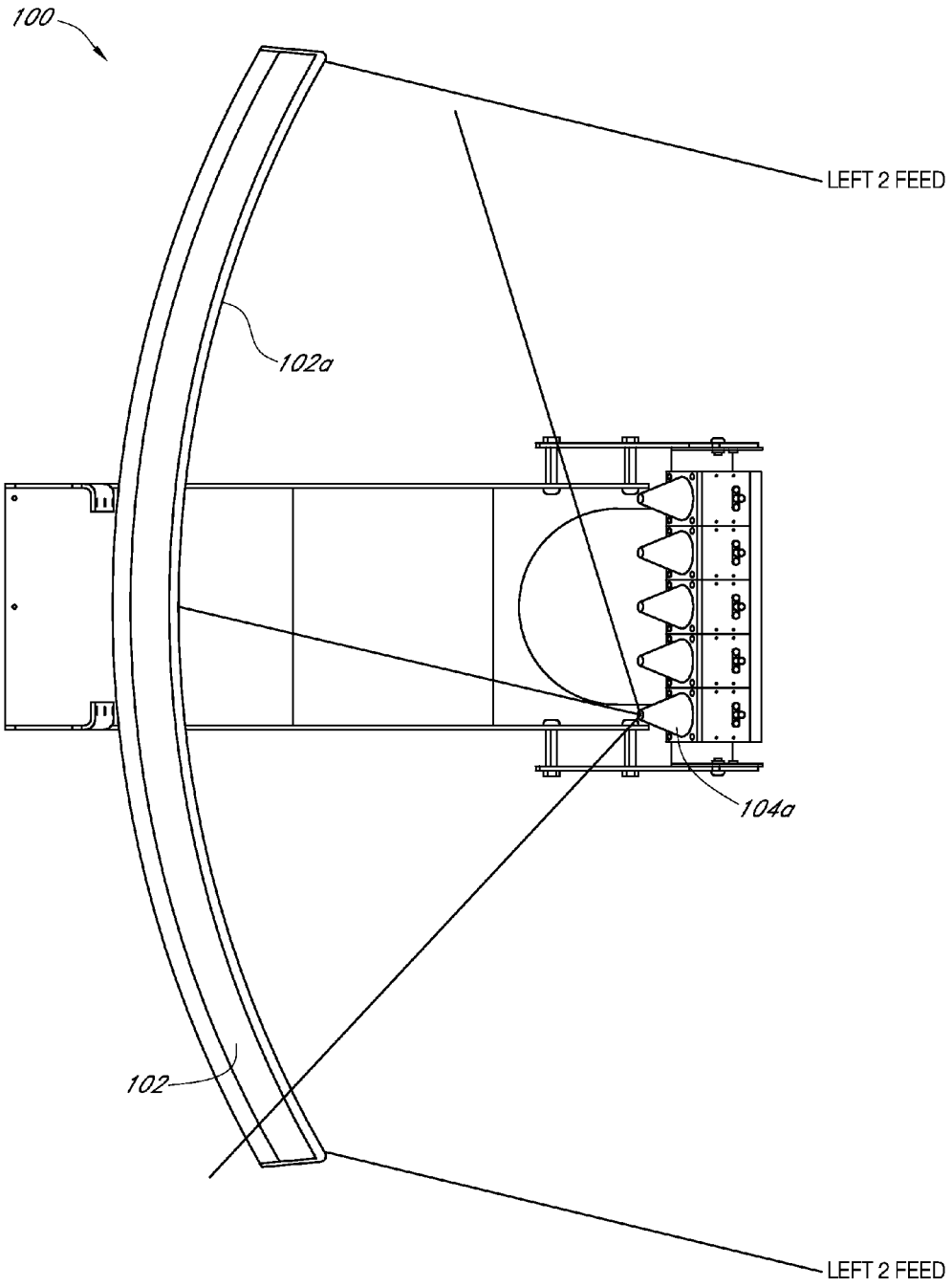
Figure 2E:
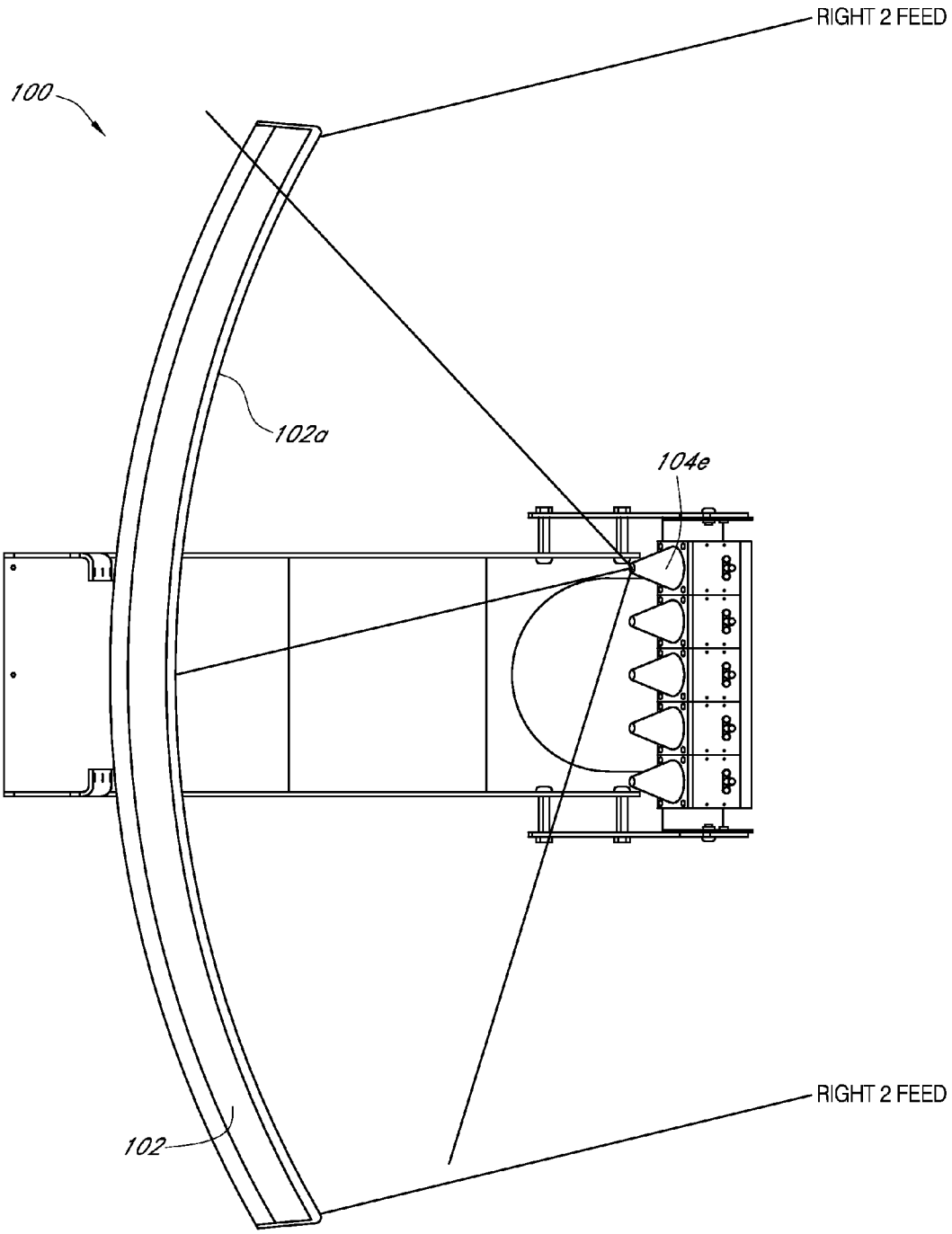

FIG. 2D and FIG. 2E are top views of the antenna system 100 and show a "left 2 feed" direction and a "right 2 feed direction," respectively. Similar to the above-described figures, the feed antennas 104*a* and 104*e* will experience a maximum gain when receiving signals from a direction generally parallel to the a "left 2 feed" direction and the "right 2 feed direction," respectively. In some embodiments, each of the "left 2 feed" and "right 2 feed" are angled from the "main feed" by about 12-14 degrees. In some embodiments, the maximum gain of the feed antennas 104*a* and 104*e* is reduced by about 12-14 dBi as compared to the maximum gain of the central feed antenna 104*c*. However, as one of skill in the art will appreciate from the above description, the combination of the central feed antenna 104*c* and the reflector 102 with one or more of the additional feed antennas 104*a*, 104*b*, 104*d*, and 104*e* will effectively increase the azimuth of the antenna system 100, in some examples by about 24-28 degrees, as compared to an antenna system omitting auxiliary feed antennas. One of skill in the art will further appreciate that as multi-path signals may be received by the reflector 102 at various angles, such auxiliary feed antennas may receive them at the full gain of the reflector-feed combination. This configuration increases the effectiveness of the antenna system 100 for diversity in the direction of the RF energy.

Figure 3A:
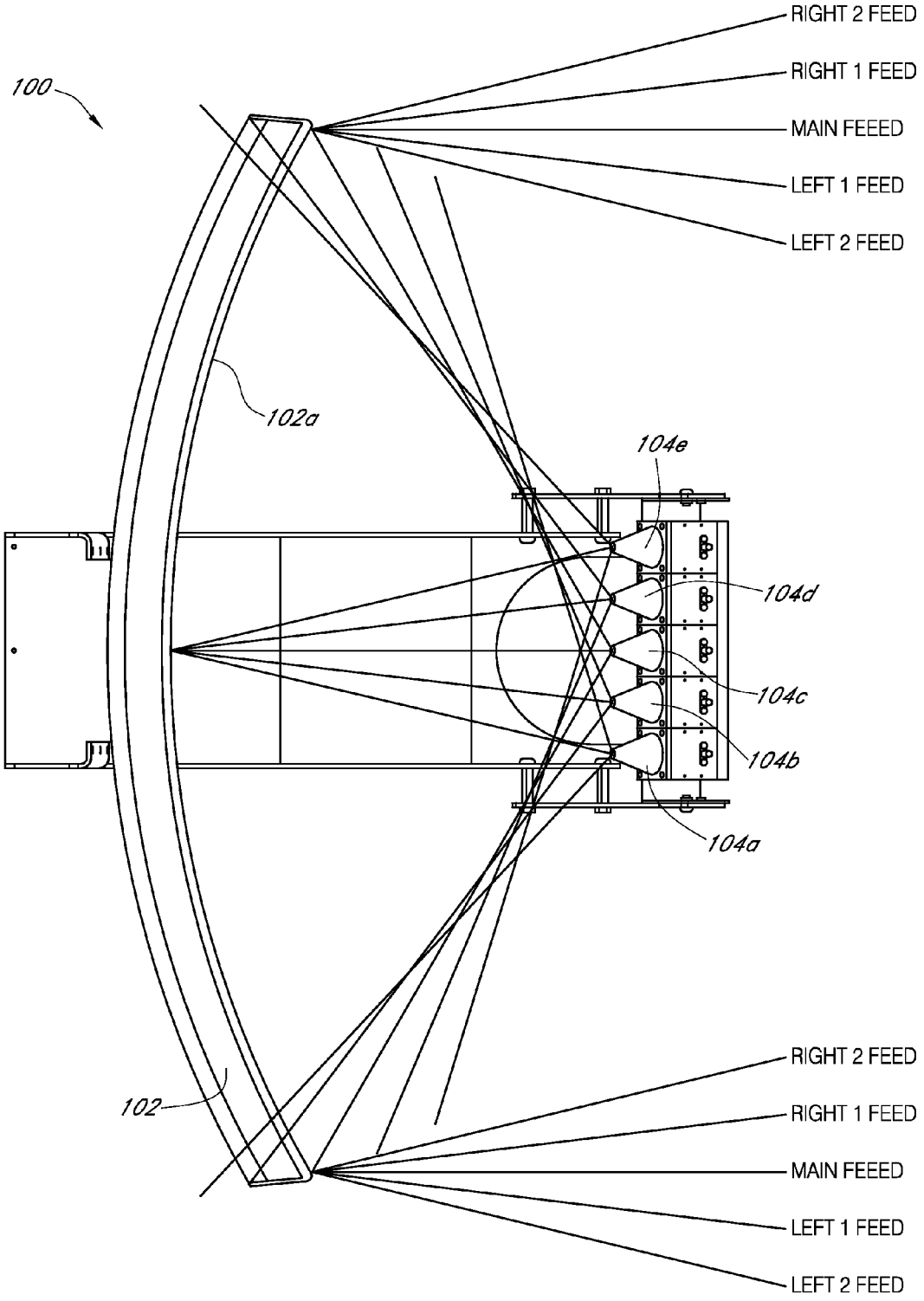
FIG. 3A is another top view of the antenna system of FIG. 1 and shows an accumulation of receive paths over which the antenna system may receive signals from a transmission source.

FIG. 3A is another top view of the antenna system 100 and shows an accumulation of receive paths over which the antenna system 100 may receive signals from a transmission source. As described above, the combination of the central feed antenna 104*c* and the reflector 102 with the feed antennas 104*a*, 104*b*, 104*d*, and 104*e* will effectively increase the directions from which a signal can be adequately received. FIG. 3A shows that the antenna system 100 can receive signals from directions generally parallel to the "left 2 feed" direction, "left 1 feed" direction, main feed direction, "right 1 feed" direction, and "right 2 feed" direction. Signals may further be received from directions between any of these illustrated feed directions. One of skill in the art will recognize that the azimuth over which signals may be received may therefore be improved without a significant reduction in gain, as can be seen by comparing FIG. 2A with FIG. 3A.

Figure 3B:
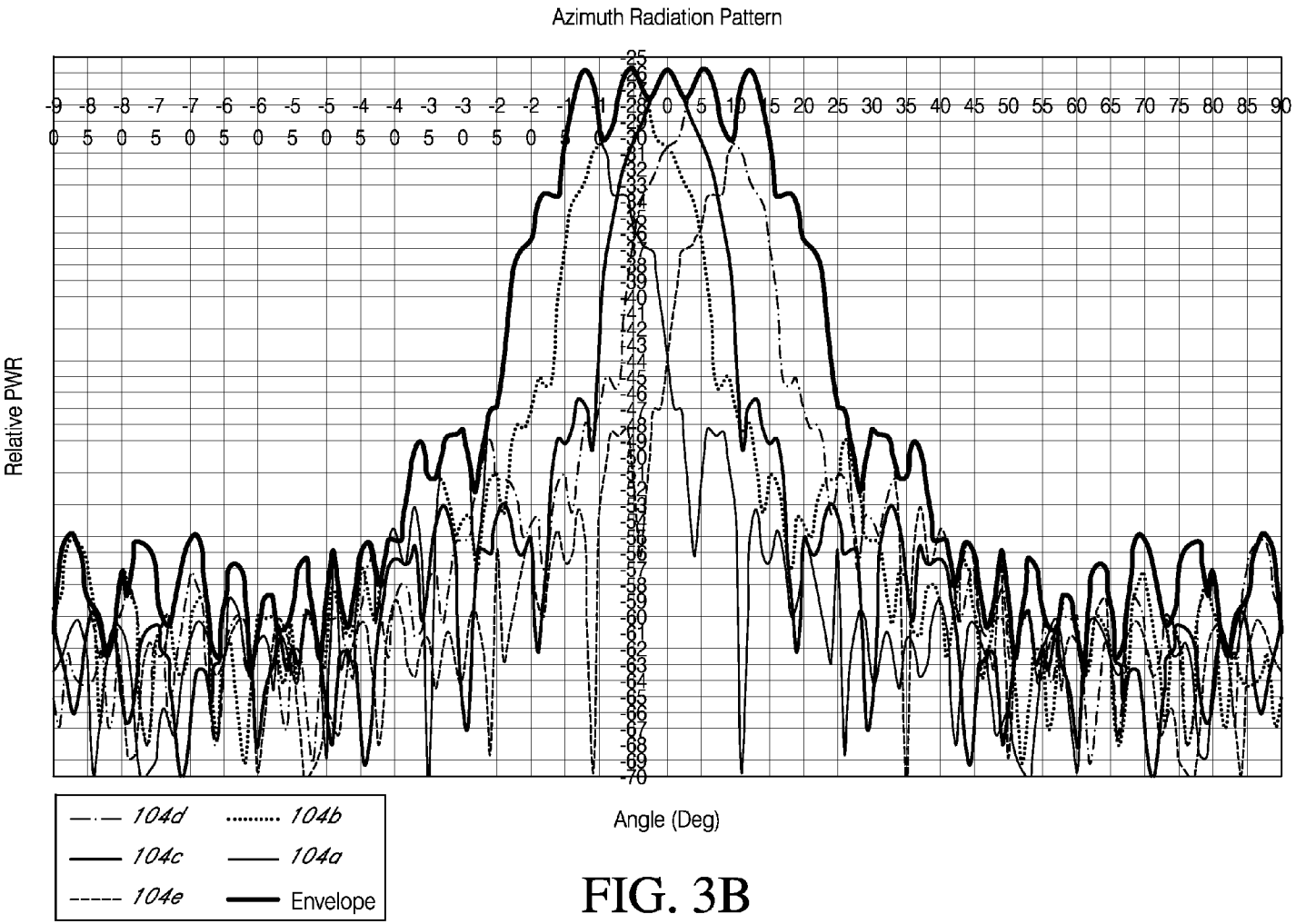
FIGS. 3B and 3C are plots of deflection of a signal received at the antenna system of FIG. 1 relative to a main feed direction in comparison with a signal strength of the received signal.
Figure 3C:
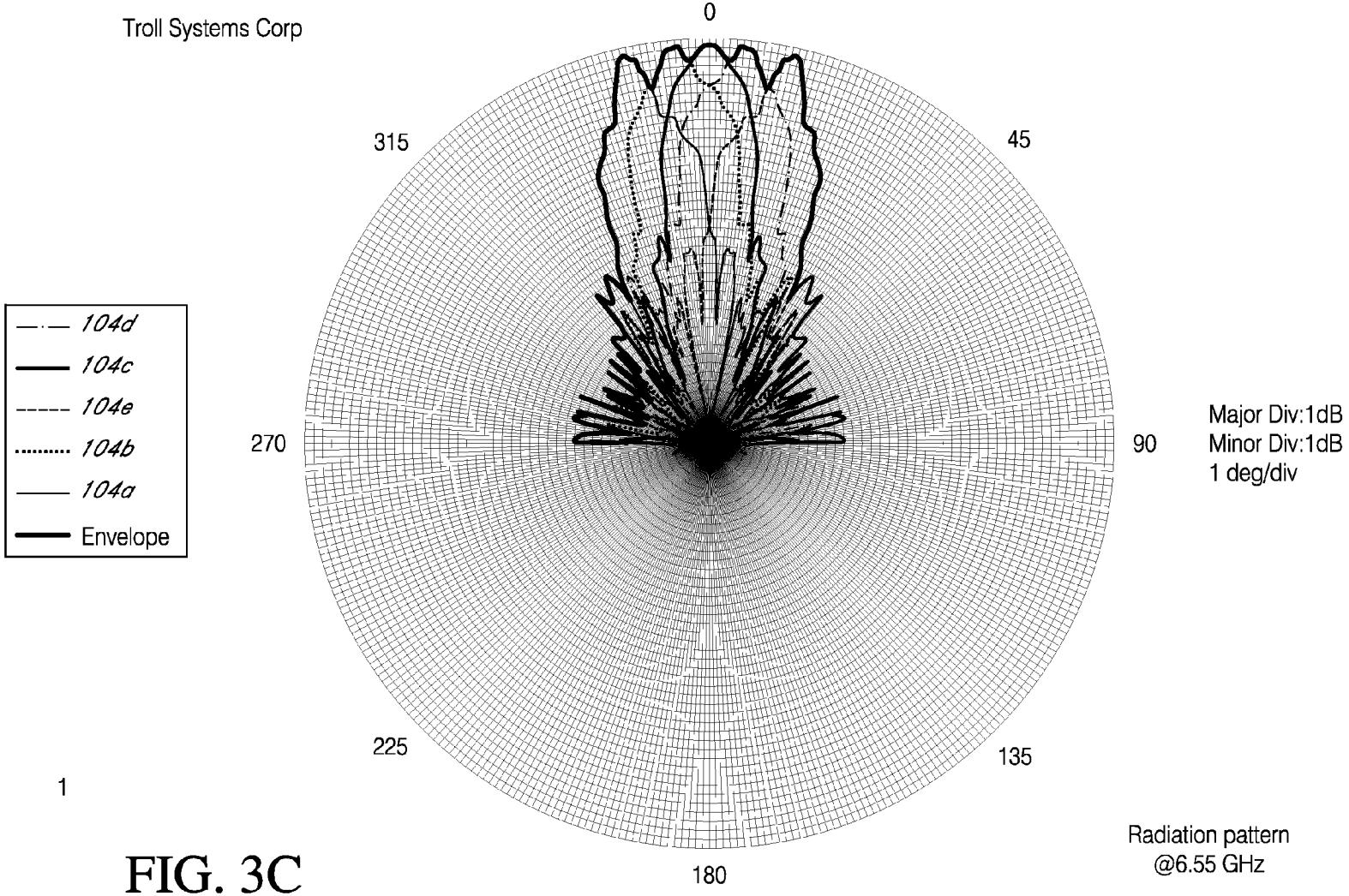

FIG. 3B is a plot of deflection of a signal received at a test embodiment of the antenna system 100 as described herein relative to a main feed direction, in comparison with a signal strength, expressed as a relative power, of the received signal. A test was conducted in which a signal was transmitted towards the test embodiment and was received by a central feed antenna and four auxiliary feed antennas approximately arranged as described with respect to the plurality of feed antennas 104*a*-104*e*. As can be seen in FIG. 3B, the direction from which the signal was received with maximum strength by the central feed antenna 104*c* has been designated as having an angle of zero. As can also be seen, the signal was received with maximum strength by the feed antennas 104*b*, 104*d*, 104*a*, and 104*e* from directions angled approximately 5 degrees and 12 degrees from zero. An "envelope" illustrated in FIG. 3B illustrates the strength of the signal when received by the embodiment of the antenna system 100 as a whole. FIG. 3C similarly illustrates an "envelope" and the strength of the signal as received by the feed antennas 104*a*-104*e*.

Figure 4:
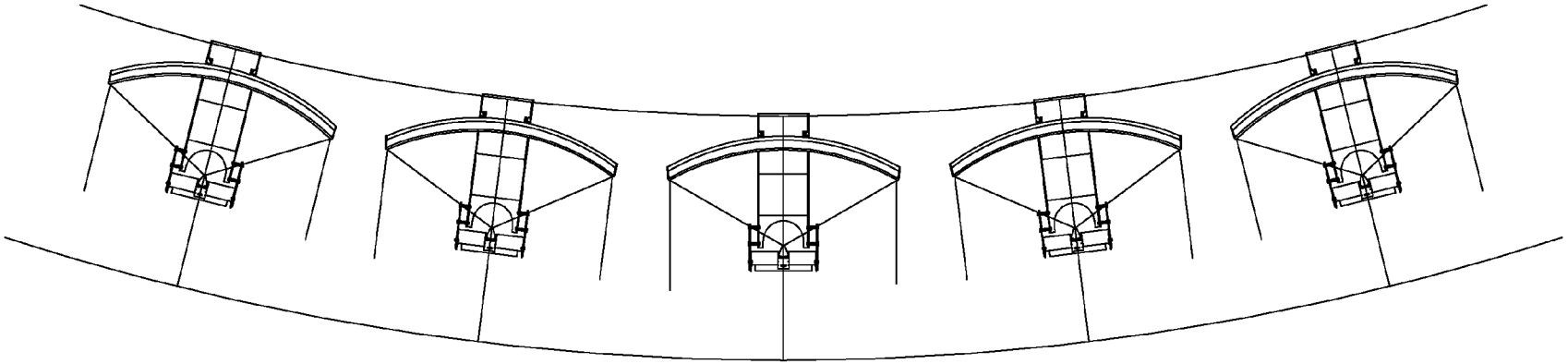
FIG. 4 is a diagram illustrating a system having a plurality of antennas that are known in the prior art.

As one of skill in the art will appreciate, the combined RF pattern of the antenna system 100, and of the test embodiment, increases the beam-width of a traditional antenna. The antenna system 100 effectively creates the illusion of a number of high gain directional antennas oriented in a plurality of directions, as illustrated in FIG. 4. Although the illustrated and test embodiment includes the reflector 102, other means of focusing or collecting wireless signals may be used instead of the reflector 102, or in addition to the reflector 102. For example, the antenna system 100 may include a waveguide, horn, and/or other such component to focus or collect wireless signals. Those of skill in the art will appreciate that certain of these signal collecting components may comprise a reflective surface. For example, many horns incorporate shaped reflective surfaces to collect radio waves or other wireless signals striking them and direct or focus them onto the actual conductive elements. Thus, certain embodiments may include a reflector or reflective surface even in the absence of a parabolic reflector such as illustrate by the reflector 102.

Figure 5:
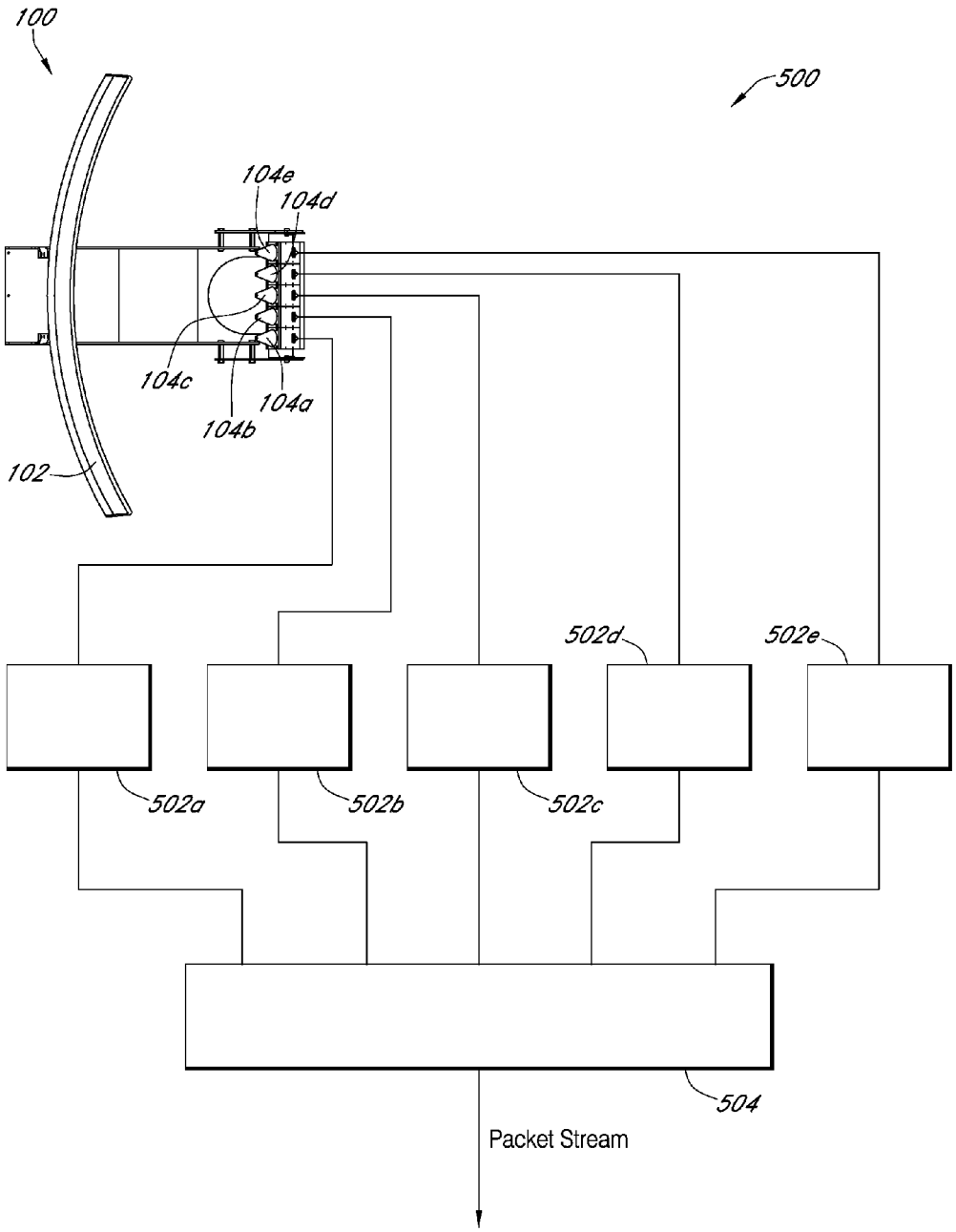
FIG. 5 is a block diagram of a receive system including the antenna system of FIG. 1.

FIG. 5 is a block diagram of one example of a receive system including the antenna system 100. The receive system 500 may further include a plurality of receivers/demodulators 502*a*-502*e* and a combiner/controller 504. Each of the receivers/demodulators 502*a*-502*e* are connected to a respective one of the feed antennas 104*a*-104*e*. The receivers/demodulators 502*a*-502*e* are configured to convert wireless signals received by the feed antennas 104*a*-104*e* from a common source into appropriate electrical signals and to demodulate and decode the appropriate electrical signals. For example, the receivers/demodulators 502*a*-502*e* may be configured to convert an RF signal into a baseband or intermediate signal, and may be further configured to decode data into a bit stream. The receivers/demodulators 502*a*-502*e* are further configured to present packets, for example ASI packets, containing the data to the combiner/controller 504. It will be appreciated that all the functionality of FIG. 5 may be implemented in the same or separate devices, circuits, or software modules. For example, each of the receivers/modulators 502*a*-502*e* and the combiner/controller 504 may be implemented as separate integrated circuits, chips, or other hardware components or in software components, or one or more of the receivers/modulators 502*a*-502*e* and the combiner/controller 504 may be combined using such components.

The combiner/controller 504 is configured to receive packets, for example ASI packets, from each of the receivers/demodulators 502*a*-502*e*, and to generate a good packet from the packets output by the receivers/demodulators 502*a*-502*e*. This good packet is output for reproduction, for example to a HD or SD video decoder. The combiner/controller 504 may use any of a number of methods to determine or generate a good packet; several examples of such methods are described below with respect to FIG. 6. Each successive good packet is output by the combiner/controller 504 to produce a combined packet stream suitable for reproduction. In this way, the receive system 500 may be configured to implement MRC by receiving a signal from a common source with the plurality of feed antennas 104*a*-104*e*. Further, multipath propagation and/or shifts in the direction from which a signal is being received will not substantially affect proper reception of the signal. In the illustrated embodiment, the combiner and controller is illustrated as being a single device, but in some embodiments the combiner and controller may be implemented in separate devices, circuits, or software modules, or there may be a plurality of combiners and/or controllers.

In some embodiments, the receive system 500 further comprises means for down-converting or up-converting the signal frequency to fit the frequency expected by a receiver, which may be implemented instead of or in addition to the receivers/demodulators 502*a*-502*e*. Also, in some embodiments, the receive system 500 further comprises means for filtering of a signal, for example filtering of an RF signal. Additionally, in some embodiments, the receive system 500 further comprises a means for individual feed polarization.

In some embodiments, the receivers/demodulators 502*a*-502*e* and/or the combiner/controller 504 is configured to calculate metrics describing the amount and quality of wireless signal (which may be called "receiver metrics") being received by the feed antennas 104*a*-104*e*. Due to the fixed relationship of the feed antennas 104*a*-104*e* to each other, the combiner/controller 504 can determine the direction of the wireless signal. Such information may be presented to a user of the receive system 500, for example using a display device (not illustrated), or may be used by the combiner/controller 504 to command the antenna system 100 to move. Such movement may increase or maximize the signal energy being received by the antenna system 100, and in particular by the central or prime focus feed 104*c*. The receive system 500 can then maintain this relationship in which the signal energy is maximized by constantly evaluating the receiver metrics and adjusting the position of the antenna system 100 to maintain the receiver metrics at an optimum. For example, the antenna system 100 can be moved such that the signal is being received from the "main feed" direction by the central (prime focus) feed antenna 104*c* for a maximum amount of time.

For these purposes, the antenna system 100 may be configured to rotate. In one embodiment, the antenna system 100 is configured to rotate 360 degrees. Thus, the face 102*a* can be situated toward any direction, and the antenna system 100 can receive signals from any direction. The system 500 may include a servo mechanism or other means of rotating the antenna system 100. Rotation of the antenna system 100 may be used to track a signal, for example when the source of the signal is moving. The wide azimuth of signal reception provided by the feed antennas 104*a*-104*e* may ensure that such signal may be accurately received and tracked even when the source is moving with great speed.

In some embodiments, the receive system 500 further includes another antenna, such as an omni antenna or one or more sector antennas. This other antenna or antennas can be used to capture wireless signals over an azimuth greater than received by the antenna system 100. In the case of an omni antenna, 360 degree wireless signal capture coverage can be provided. The output of this other antenna can be fed to the combiner/controller 504 to assist in the initial capture of the wireless signal and setting of the initial orientation of the antenna system 100, and/or could be used as another spatially diverse input. For example, an omni antenna may be used to initially receive a signal from a moving source, such as jet aircraft, and the feed antennas 104*a*-104*e* used to thereafter receive and track the signal.

In one embodiment, the receive system 500 includes a plurality of sector or panel antennas. For example, the antenna system 100 may be surrounded by a plurality of sector antennas, or the base of the antenna system 100 may be disposed within a periphery or circumference of panel antennas. A steerable antenna in combination with a plurality of fixed or mechanically coupled antennas is disclosed in U.S. patent application Ser. No. 12/605,279, filed Oct. 23, 2009, and entitled "DIRECTIONAL DIVERSITY RECEIVE SYSTEM," the entire disclosure of which is hereby incorporated by reference in its entirety. In some embodiments, the antenna system 100 described herein may be implemented in place of the steerable antenna describe in U.S. patent application Ser. No. 12/605,279. In such embodiment, each of the fixed antennas described in that application may be connected to a respective receiver/demodulator in the receive system 500, and each of those receivers/demodulators as well as the receivers/demodulators 502*a*-504*e* may output packets to the combiner/controller 504 to generate a transport stream.

In some embodiments, the receive system 500 may be packaged together, and may be configured for relocation as an integral unit. In some embodiments, the operation of the receive system 500 is automated so that maintenance and required interaction by a user of the receive system 500 can be reduced.

Figure 6:
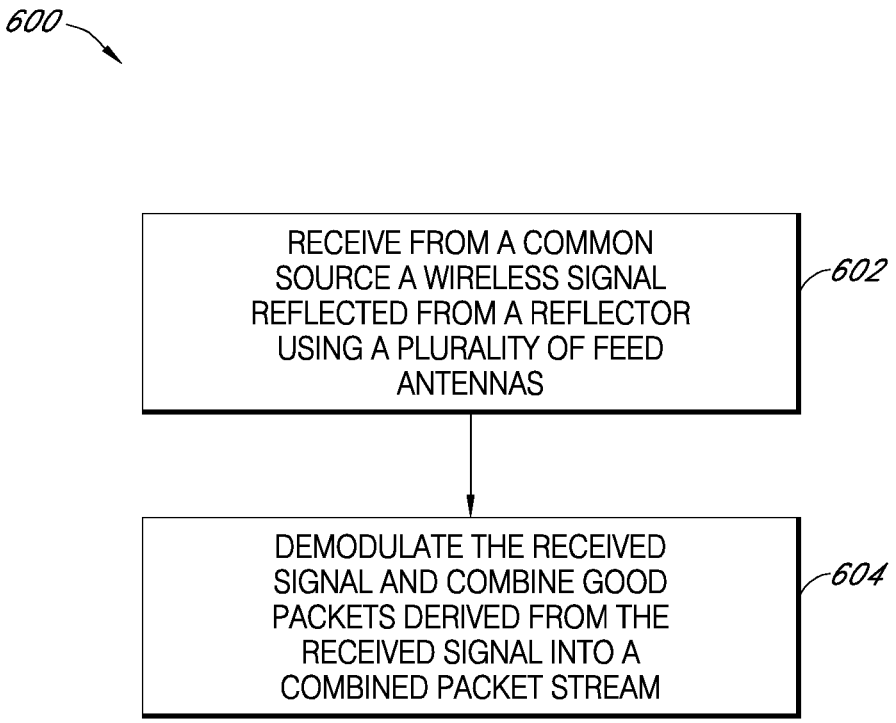
FIG. 6 is a flowchart illustrating a method of receiving a signal at the receive system of FIG. 5.

FIG. 6 is a flowchart illustrating a method 600 of receiving a signal at a receive system, for example the receive system 500. The acts associated with the method 600 may be performed by different configurations of the receive site system 500 than those herein described. Those skilled in the art will know how to extend the method described to different configurations of the receive system 500.

At block 602, a wireless signal reflected from a reflector, such as the reflector 102, is received from a common source using a plurality of feed antennas, such as the feed antennas 104*a*-104*e*. As described above, the feed antennas may be arranged to provide spatial diversity and may receive a signal from a variety of different angles.

At block 604, the signal is demodulated by each of a plurality of demodulators, such as the receivers/demodulators 502*a*-502*e*, connected to respective ones of the feed antennas. Each demodulator may output a packet derived from the signal received by its respective feed antenna. A combiner, such as the combiner/controller 504, may then generate a good packet from the packets output by the demodulator. The combiner may continue to generate good packets from each subsequent set of packets output by the demodulators to create a combined packet stream. In some embodiments, the packets comprise ASI packets. Reception of information from a common source may be enabled by appropriate physical configuration of the feed antennas and/or by appropriate configuration or implementation of the demodulators or receivers, for example.

In one embodiment, each demodulator independently outputs a packet. In this embodiment, the combiner may evaluate whether each of the packets is a good packet, for example by determining if there are any errors in the packet using a checksum or other error detection or correction technique. When multiple demodulators output a good packet, any of these good packets may be chosen by the combiner. When only one demodulator outputs a good packet, that packet is selected by the demodulator. In another embodiment, the signal as received at each of the plurality of feed antennas is combined and a packet is generated from this combined signal. The signal may be combined using a simple summation or averaging, or may be combined using a weighted ratio, which may, for example, be weighted according to a signal-to-noise ratio with which the signal was received at each of the plurality of antennas. In still other embodiments, a packet may be generated by selecting good bits from packets generated by each demodulator. The combiner may output packets or a bit stream or other data signal not comprising packets. A bit stream or sequence of good packets may be generated using one or more of the techniques described above, or using other techniques as will be known to those skilled in the art.

The method 600 may further comprise determining which of the feed antennas received the wireless signal with the highest robustness. The robustness may be determined using a variety of parameters. For example, at least one of a signal to noise ratio, a modulation error ratio, a signal strength, and a pre-Viterbi or post-Viterbi bit error rate may be used in the determination. The pre-Viterbi and/or post-Viterbi bit error rate may indicate the proportion of error correction that is performed on a signal, and may reveal the portions of the signal that are recovered. The determination may be performed by the combiner/controller 504, for example, or by any sort of computer, controller, microcontroller, or other logic device. The determination process can be automated such that a user or operator of the receive site system need input little or no information.

The method 600 may also further comprise rotating a reflector and feed antennas so that the signal may subsequently be received with an increased or a maximum robustness. In some embodiments, this comprises steering the reflector so as to approximately align with the direction of the feed antenna that received the wireless signal with the highest robustness. In some embodiments, this comprises rotating the reflector and feed antennas such that a main feed direction is aligned with the direction of the feed antenna that received the wireless signal with the highest robustness. This may cause the signal to reflect off of the reflector such that the reflected signal passes through a focus of the reflector or is received by a central feed antenna. In this way, the chances of properly receiving the wireless signal at the receive system can be greatly increased. Not only can auxiliary feed antennas be used to receive the wireless signal, they can be used to direct the reflector. As described above, this may increase the likelihood that the signal is received at high gain by the reflector and feed antennas. Increasing the likelihood of receiving a signal at high gain is beneficial in many situations, for example when tracking a signal source that is located far away such as a quickly moving aircraft.

The method 600 may be automated such that little or no input is required by a user or operator of the receive site system. The process 600 may thus increase the speed and accuracy at which a signal may be received and/or tracked. A wireless signal may be properly received even if the source of the signal is moving or is otherwise misaligned with the reflector and feed antennas.

Those skilled in the art will appreciate that the receive site system may be configured for relocation as an integrated module. Thus, the plurality of feeds, the steerable reflector, the receivers/demodulators 502*a*-502*e*, the combiner/controller 504, and other antennas such as an omni antenna may be integrated into a single unit. In this way, spatial diversity can be achieved with the feed antennas and increased signal reception strength can be achieved, for example by utilizing a central feed antenna in combination with additional feed antennas. In addition, the integrated module reduces the cost to the user by allowing the user to implement the spatial diversity and increased signal reception strength in a limited spatial area. Further, the system may accurately receive shifting signals, for example due to a source of the signal moving or due to obstructions in the signal path, and track those signals if desired.

Those of skill in the art will appreciate that the systems described herein effectively increase the number of high gain antennas receiving a wireless signal. This increases the effective robustness of the system as the wireless signal gets further and further away. Additionally, the azimuth of reception will be increased.

Those of skill in the art will further appreciate that the systems described herein may be used to receive a signal being transmitted from a common source at a great distance. The feed antennas are configured to receive the signal with a high gain, thus increasing the distance from which the signal may be transmitted. In addition, at such increased distance, movement of the source will likely cause a minimal deflection of the signal from the "main feed" direction. This deflected signal can be adequately received by the system, and the system can be steered toward the new location of the signal source. Such reception of signals from a plurality of directions, which therefore increases the effective azimuth of the system, may produce a diversity that is currently unknown in the art, and which may be referred to as directional diversity.

In this way, the system can be configured to receive the same signal from a plurality of directions instead of configured to receive separate signals from separate sources, as is common with known systems implementing a plurality of antennas. In addition, any interference that may be experienced by known systems implementing a plurality of antennas will be reduced by the high gain and effective azimuth of the present system. The effects of multipath, interference, and fading will be reduced and the system will receive the signal with improved robustness as compared to traditional diversity systems employing spatial, frequency, and/or feed diversity.

Embodiments disclosed herein may allow the addition of more receivers, demodulators, and/or antennas into a receive site system. Thus, the receive system may avoid signal propagation and reception issues by using diversity, while reducing overall cost of the system and increasing ease of use. The receive system may be operated to automatically track a signal to ensure that the signal is received with the highest possible robustness. In this way, the input and sophistication required of a user is reduced.

The properties and advantages of the system described above may be used to track a quickly moving transmission source from a great distance. For example, the system may be used to automatically track and receive signals from an automobile, train, or aircraft. Such vehicles may move at great speed and may necessarily be located or travel to a location far from the system. Those of skill in the art will recognize that use of the present system may enable reception of a signal from such vehicle regardless of these difficulties. Traditional diversity receive systems implementing a plurality of antennas are presently unable to perform reliable reception under these circumstances because they are unable to receive a signal from the source with sufficient strength and/or are unable to properly track the signal as the source moves.

The structure and the operation of the disclosed system and methods are not limited to the above descriptions. Various modifications may be made without departing from the spirit and scope of the present invention. While the above description has shown, described, and pointed out novel features of the system and methods as applied to various embodiments, it will be understood that various omissions, substitutions, and changes in the form and details illustrated may be made by those skilled in the art without departing from the spirit of the invention.

What is claimed is:

1. An method of receiving wireless signals, comprising:

receiving one or more wireless signals at a plurality of feed antennas of an antenna system;

outputting a plurality of feed signals from the plurality of feed antennas to a receiver of the antenna system;

demodulating the plurality of feed signals at the receiver in order to generate feed signal data;

processing the feed signal data at a controller of the antenna system;

outputting from the controller a control signal configured to cause the antenna system to rotate the plurality of feed antennas in order to increase a strength of the one or more wireless signals received by the antenna system.

2. The method of receiving wireless signals of claim 1, further comprising:

reflecting the one or more wireless signals off a wireless signal reflector configured to reflect the wireless signal towards the plurality of feed antennas; and rotating the wireless signal reflector in order to increase the strength of the one or more wireless signals received by the antenna system.

3. The method of receiving wireless signals of claim 2, wherein receiving the one or more wireless signals at a plurality of feed antennas further comprises receiving at least one of the one or more wireless signals at a waveguide.

4. The method of receiving wireless signals of claim 2, further comprising: receiving at least one of the one or more wireless signals at an omni antenna or a sector antenna of the antenna system.

5. The method of receiving wireless signals of claim 2, further comprising: determining, by the controller, a robustness of one or more of the feed signals based on the feed signal data.

6. The method of receiving wireless signals of claim 5, further comprising: rotating the wireless signal reflector and the plurality of feed antennas in order to increase the robustness of one or more of the feed signals.

7. The method of receiving wireless signals of claim 6, wherein determining the robustness of one or more of the feed signals comprises determining at least one parameter associated with the feed signal data.

8. The method of receiving wireless signals of claim 7, wherein the at least one parameter is one of a signal to noise ratio, a modulation error ratio, a signal strength, a pre-Viterbi bit error rate, or a post-Viterbi bit error rate.

9. The method of receiving wireless signals of claim 2, wherein the wireless signal reflector is one of a parabolic reflector, a corner reflector, an off-center reflector, or a cassegrain reflector.

10. The method of receiving wireless signals of claim 2, wherein the wireless signal reflector and the plurality of feed antennas are connected by a support member, and wherein the support member is connected to a rotating means.

11. The method of receiving wireless signals of claim 10, wherein the rotating means is a servo mechanism.

12. The method of receiving wireless signals of claim 2, wherein the plurality of feed antennas comprise a central feed antenna and a plurality of auxiliary feed antennas arranged in a symmetric pattern around the central feed antenna.

13. The method of receiving wireless signals of claim 12, wherein the plurality of feed antennas are arranged in an approximately linear configuration.

14. The method of receiving wireless signals of claim 2, wherein the plurality of feed antennas comprise a central feed antenna and a plurality of auxiliary feed antennas arranged in an asymmetric pattern around the central feed antenna.

15. The method of receiving wireless signals of claim 2, wherein the plurality of feed antennas are arranged in a non-linear configuration.

16. The method of receiving wireless signals of claim 1, wherein at least one of the plurality of feed antennas is a horn antenna.

17. The method of receiving wireless signals of claim 1, wherein at least one of the plurality of feed antennas is a sector antenna.

18. The method of receiving wireless signals of claim 1, wherein a rotating means rotates the plurality of feed antennas.

19. The method of receiving wireless signals of claim 18, wherein the rotating means is a servo mechanism.

* * * * *